US008333486B2

(12) United States Patent
Kung

(10) Patent No.: US 8,333,486 B2
(45) Date of Patent: Dec. 18, 2012

(54) ILLUMINATION DEVICE WITH HEAT DISSIPATION STRUCTURE

(75) Inventor: Sheng-Hsiang Kung, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 317 days.

(21) Appl. No.: 12/797,484

(22) Filed: Jun. 9, 2010

(65) Prior Publication Data

US 2011/0103079 A1 May 5, 2011

(30) Foreign Application Priority Data

Oct. 29, 2009 (CN) ..... 2009 1 0309031

(51) Int. Cl.
*F21V 29/00* (2006.01)

(52) U.S. Cl. ..... 362/294; 362/249.02

(58) Field of Classification Search ..... 362/97.3, 362/218, 646, 249.02, 294, 373
See application file for complete search history.

(56) References Cited

U.S. PATENT DOCUMENTS

| | | | | |
|---|---|---|---|---|
| 2006/0034085 | A1 * | 2/2006 | Wang et al. | 362/294 |
| 2006/0126354 | A1 * | 6/2006 | Fu | 362/545 |
| 2007/0081340 | A1 * | 4/2007 | Chung et al. | 362/294 |
| 2007/0283604 | A1 | 12/2007 | Kaoh | |
| 2010/0053966 | A1 * | 3/2010 | Tu et al. | 362/249.02 |

FOREIGN PATENT DOCUMENTS

| | | | | |
|---|---|---|---|---|
| CN | 2729509 | Y | | 9/2005 |
| JP | 5-299702 | A | | 11/1993 |
| JP | 2003-77312 | A | | 3/2003 |
| JP | 2004-55800 | A | | 2/2004 |
| JP | 2005-108544 | | | 4/2005 |
| JP | 2005108544 | A | * | 4/2005 |
| WO | 2007091832 | A1 | | 8/2007 |

* cited by examiner

*Primary Examiner* — David V Bruce
(74) *Attorney, Agent, or Firm* — Altis Law Group, Inc.

(57) ABSTRACT

A solid state lighting source illumination device comprising a bracket and at least one solid state lighting source module. The solid state lighting source module comprises a substrate and at least one solid state lighting source. The substrate is set up with circuit and the solid state lighting source is set up on the substrate, and the electrode of the solid state lighting source is electrically connecting with the circuit on the substrate. The substrate and the bracket further comprise a heat dissipation structure which is a space between the substrate and a base of the bracket and through holes in the substrate near the solid state lighting source.

6 Claims, 5 Drawing Sheets

ILLUMINATION DEVICE WITH HEAT DISSIPATION STRUCTURE

BACKGROUND

1. Technical Field

The present disclosure relates to illumination devices, and particularly to a illumination device having an unique heat dissipation structure.

2. Description of Related Art

Light emitting diodes' (LEDs) have many advantages, such as high luminosity, low operational voltage, low power consumption, compatibility with integrated circuits, easy driving, long-term reliability, and environmental friendliness; thus, LEDs have been widely promoted as a light source.

Joseph Bielecki et al. in IEEE, 23rd IEEE SEMI-THERM Symposium, "Thermal Considerations for LED Components in an Automotive Lamp." characterize light emitting diodes as a kind of semiconductor device changing current into light of specific wavelength.

However, there are still some problems with the solid-state lighting source like LED, especially in heat dissipation. The higher the power of the solid-state lighting source is, the more heat the solid-state lighting source produces. It is also much more difficult to dissipate heat in a smaller solid-state lighting source illumination device.

As well, the present solid state lighting source illumination device all contain the problem of heat dissipation, limiting the application in daily life. High efficiency of heat dissipation is not available.

What is needed therefore, is an illumination device which can ameliorate the described limitations.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
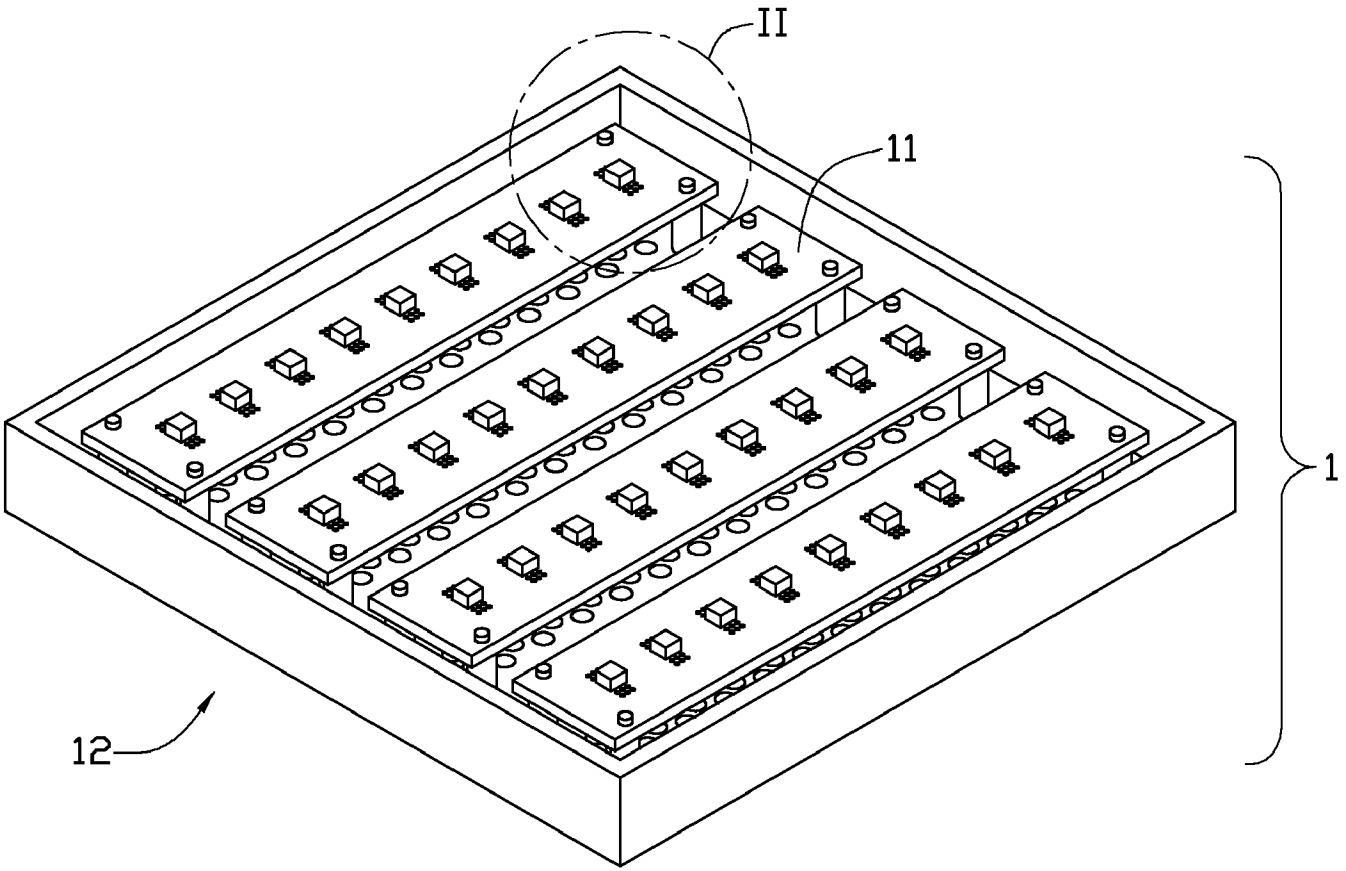
FIG. 1 is a schematic view of a solid state lighting source illumination device in accordance with a first embodiment.

Referring to FIG. 1, a solid-state lighting source illumination device 1 in accordance with a first embodiment includes a power module (not shown), at least one solid-state lighting source module 11, and a bracket 12.

Figure 2:
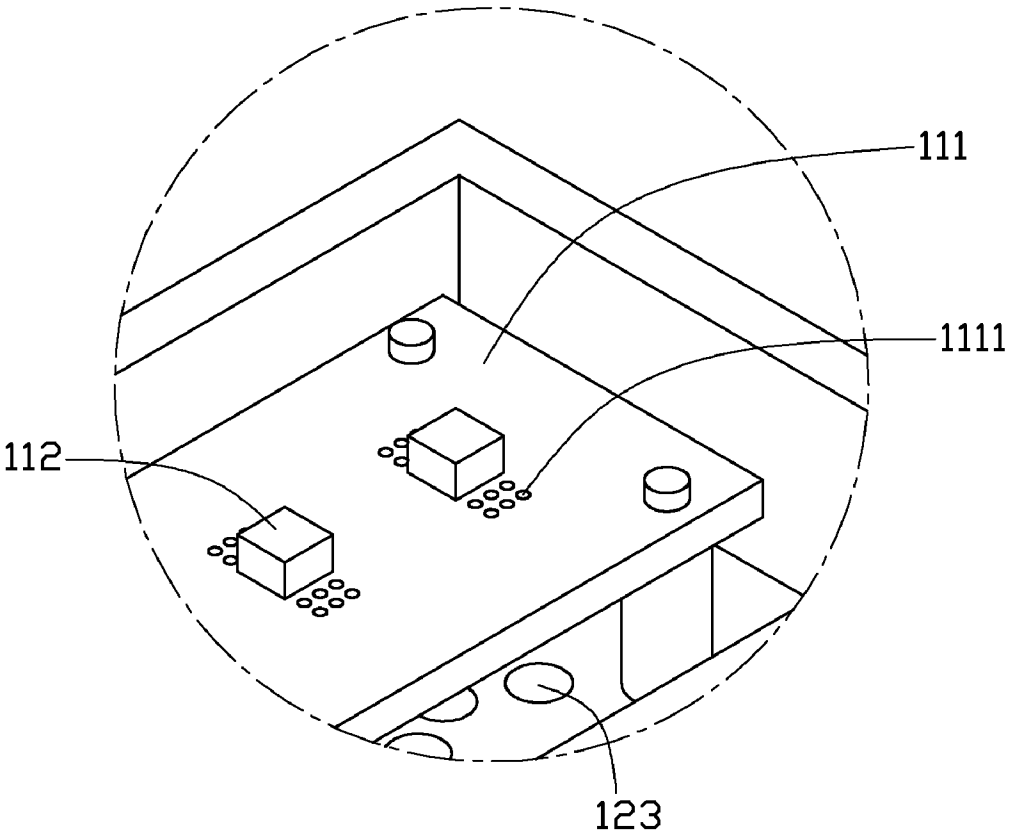
FIG. 2 is an enlarged schematic view of a section II of the solid-state lighting source illumination device of FIG. 1.
Figure 3:
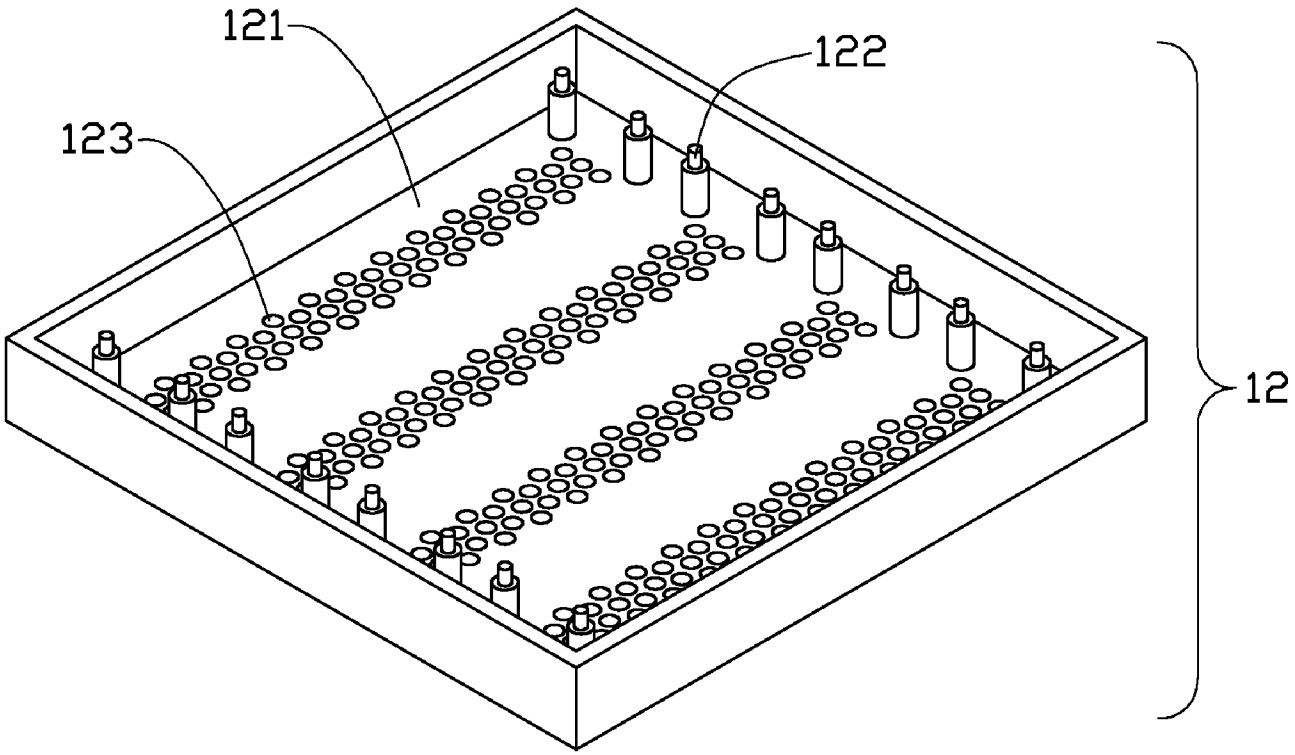
FIG. 3 is a schematic view of a bracket of the solid-state lighting source illumination device of FIG. 1.

Referring to FIG. 2 and FIG. 3, the solid-state lighting source module 11 comprises a substrate 111 and at least one solid-state lighting source 112. The substrate 111 is set up with a circuit, and the solid-state lighting source 112 is set up on the substrate 111. The electrode of the solid-state lighting source 112 is electrically connecting with the circuit on the substrate 111. The substrate 111 is fixed on the top of a base 121 of the bracket 12 and keeps a distance from the base 121 of the bracket 12 to form a heat dissipation space between the substrate 111 and the bracket 12 for a better heat dissipation effect. The solid-state lighting source 112 faces away from the base 121 of the bracket 12.

Furthermore, the space between the substrate 111 and the base 121 of the bracket 12 can electrically insulate the substrate 111 from the base 121 of the bracket 12. Wherein, there is no size limitation of the space between the substrate 111 and the base 121 of the bracket 12, as long as it is formed inside the bracket 12. Preferably, the height of the space between the substrate 111 and the base 121 of the bracket 12 is from about 1 mm to about 50 mm. More preferably, the height of the space between the substrate 111 and the base 121 of the bracket 12 is from about 15 mm to about 30 mm.

When it is needed, the solid state lighting source module 11 can further include at least one optical element (not shown), and the optical element can be a lens, a diffuser, a reflector, or a light guiding plate for adjusting the light from the solid-state lighting source 112.

Referring to FIG. 3, the bracket 12 further includes a plurality of supporters 122 which are fixed and connected with the top surface of the base 121 to support and fix the substrate 111. There are through holes 123 within the area of projection of the substrate 111 on the base 121 of the bracket 12 to communicate with the outside air to make better heat dissipation. Moreover, the substrate 111 can also block the through holes 123 on the base 121 of the bracket 12 to prevent from light leakage according to the directionality and reflection effect of solid-state lighting. Therefore, there is no special limitation for the size and shape arrangement of the through holes 123, as long as they can communicate with the outside air to allow the heat to exchange. Preferably, the radius of the through holes 123 is from about 1 mm to about 25 mm but could also be in the range from about 5 mm to about 10 mm. Wherein, the arrangement of the through holes 123 could be a matrix or they could also be randomly spaced. The shape of the through holes 123 is substantially circular.

Figure 4:
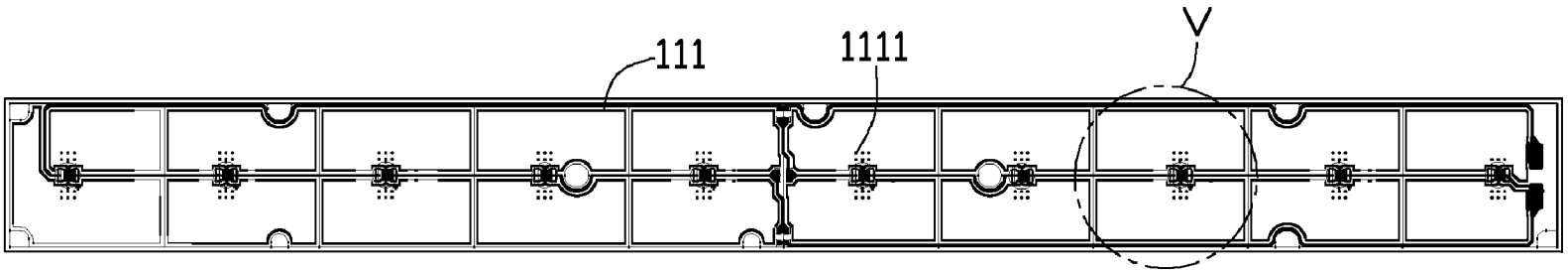
FIG. 4 is a schematic view of a substrate of the solid-state lighting source illumination device of FIG. 1.
Figure 5:
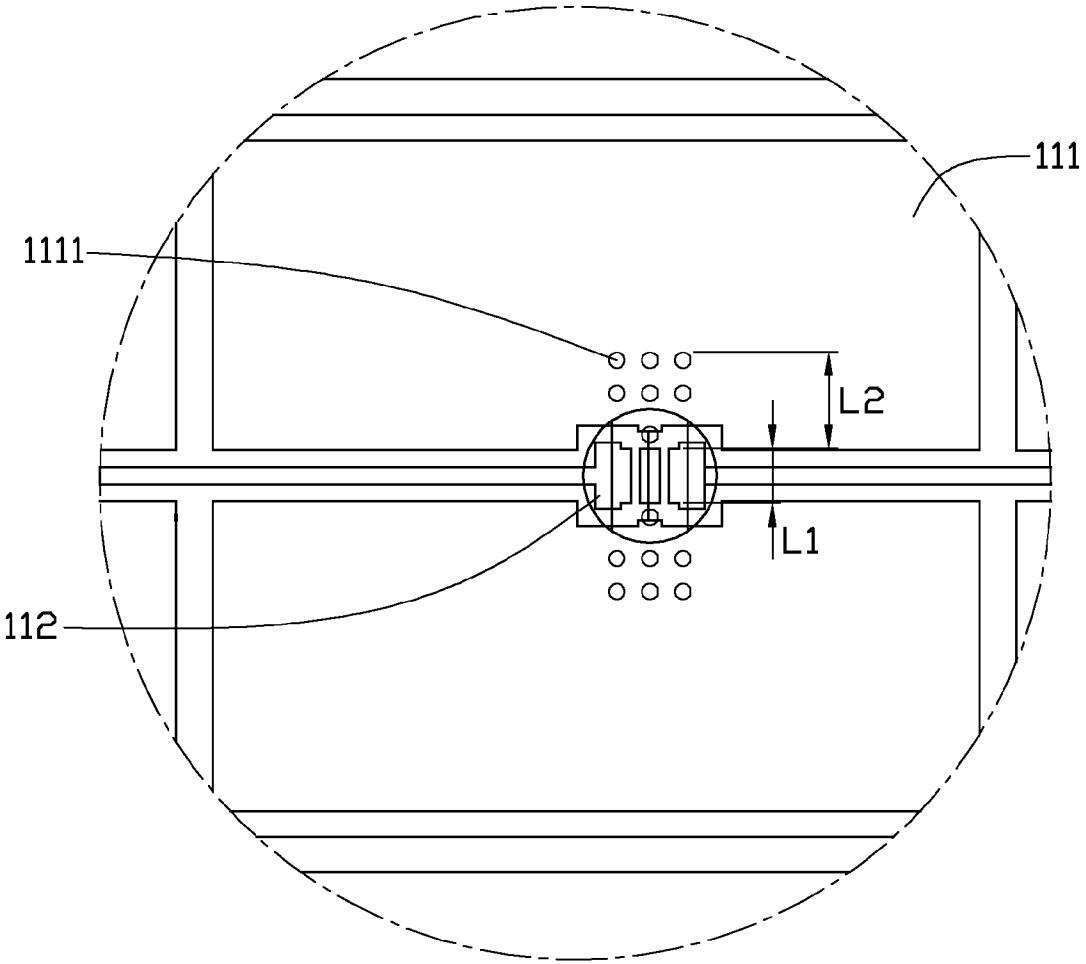
FIG. 5 is an enlarged schematic view of section V of the substrate of the solid-state lighting source illumination device of FIG. 4.

Referring to FIG. 4 and FIG. 5, the substrate 111 of the solid-state lighting source module 11 includes at least one through hole 1111. The one through hole 1111 runs vertically through both sides of the top and bottom of the substrate 111 to allow space for airflow to make better heat dissipation. Therefore, there is no special limitation about the size, arrangement, or shape of the through holes, as long as they are convenient for airflow. Preferably, the radius of the through hole is from about 0.1 mm to about 5 mm but could also be in the range from about 0.5 mm to about 1 mm. Wherein, the arrangement of the through holes is preferably matrix but could also be a mismatched spacing arrangement. Furthermore, the preferable shape of the through hole is circular.

Wherein, the width (L1) of the pad on the bottom of the solid state lighting source 112 is 4 mm, it can be regarded as the width of the solid state lighting source 112 or as the diameter of the solid state lighting source 112 when it is a circular structure. The farthest distance (L2) from the at least one through hole 1111 to the edge of the bottom pad of the solid state lighting source 112 at the direction of the width is 5.5 mm. In addition, the ratio of the length of the L2 over the length of the L1 is equal to or greater than 1.

Besides, both sides of the substrate 111 are further plated with metal layers for better heat dissipation effect. Preferably, the material of the metal layer is gold, silver, or copper. The preferable color of the substrate 111 is white.

It is to be understood, however, that even though numerous characteristics and advantages of the disclosure have been set forth in the foregoing description, together with details of the structures and functions of the embodiment(s), the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A solid state lighting source illumination device, comprising a bracket, and at least one solid state lighting source module, said solid state lighting source module comprising a substrate and at least one solid state lighting source set up on the substrate and electrically connecting with the substrate, wherein the substrate is fixed on a top of a base of the bracket and keeping a distance from the base of the bracket to form a heat dissipation space between the substrate and the bracket, the solid state lighting source facing away from the base of the bracket;

wherein the substrate is provided with through holes therein which communicate with the heat dissipation space and near the solid state lighting source so that heat generated by the solid state lighting source can be transferred to the heat dissipation space through the through holes; and wherein the color of the substrate is white.

2. The solid state lighting source illumination device of claim 1, wherein the substrate is fixed on the top of the base of the bracket by a supporter.

3. The solid state lighting source illumination device of claim 1, wherein the supporter is fixed on the top surface of the base of the bracket.

4. The solid state lighting source illumination device of claim 1, wherein a height of the heat dissipation space between the substrate and the bracket is from 1 mm to 50 mm.

5. The solid state lighting source illumination device of claim 1, wherein both sides of the substrate are plated with metal layers.

6. The solid state lighting source illumination device of claim 5, wherein the metal layers are made of gold, silver or copper.

* * * * *